US010757791B1

(12) United States Patent
Jonsson

(10) Patent No.: US 10,757,791 B1
(45) Date of Patent: Aug. 25, 2020

(54) REMOTE DIMMING OF LIGHTING

(71) Applicant: Karl S Jonsson, Rancho Santa Margarita, CA (US)

(72) Inventor: Karl S Jonsson, Rancho Santa Margarita, CA (US)

( * ) Notice: Subject to any disclaimer, the term of this patent is extended or adjusted under 35 U.S.C. 154(b) by 0 days.

(21) Appl. No.: 16/455,975

(22) Filed: Jun. 28, 2019

Related U.S. Application Data

(60) Provisional application No. 62/843,949, filed on May 6, 2019.

(51) Int. Cl.

| | |
|---|---|
| ***H05B 47/18*** | (2020.01) |
| ***F21V 23/00*** | (2015.01) |
| ***H05B 45/10*** | (2020.01) |
| ***H05B 47/185*** | (2020.01) |

(52) U.S. Cl.
CPC ..... *H05B 47/18* (2020.01); *F21V 23/003* (2013.01); *H05B 45/10* (2020.01); *H05B 47/185* (2020.01)

(58) Field of Classification Search
CPC .. H05B 39/044; H04L 12/10; H02M 3/33561; H02M 3/155; H02M 3/156; H02M 3/157; H02M 3/425; H02M 3/4225; H01R 4/12; G06F 1/266; F21V 33/0052; F21V 21/35; F21V 14/006; F21V 14/003; F21S 8/086; F21S 45/43; F21K 9/232
See application file for complete search history.

(56) References Cited

U.S. PATENT DOCUMENTS

| | | | | |
|---|---|---|---|---|
| 7,038,399 | B2 | 5/2006 | Lys et al. | |
| 7,233,115 | B2 | 6/2007 | Lys | |
| 8,558,413 | B1 | 10/2013 | Lepard | |
| 8,975,825 | B2 | 3/2015 | Hu | |
| 9,101,032 | B2 | 8/2015 | Kim et al. | |
| 9,155,171 | B1 | 10/2015 | Hughes et al. | |
| 9,295,142 | B1 | 3/2016 | Leinen et al. | |
| 9,338,860 | B2 | 5/2016 | Radermacher | |
| 10,314,141 | B2 | 6/2019 | Harvey et al. | |
| 10,609,797 | B1 | 3/2020 | Jonsson | |
| 2015/0048758 | A1 * | 2/2015 | Carrigan | H05B 47/19 315/294 |

(Continued)

OTHER PUBLICATIONS

Hirschmann, Power Over Ethernet, 2011, retrieved from http://belden.picturepark.com/Website/Download.aspx?DownloadToken=73468f0b-3d68-4ec4-a295-81d58eec2bc1&Purpose=AssetManager&mime-type=application/pdf on Mar. 23, 2019.

(Continued)

*Primary Examiner* — Seokjin Kim
(74) *Attorney, Agent, or Firm* — Young's Patent Services, LLC; Bruce A Young

(57) ABSTRACT

Power is provided to a powered device (PD) over a data cable from power sourcing equipment (PSE). A signature resistance of the device is detected through the data cable. If the signature resistance is in a first range, power is provided to the PD from the PSE over the data cable in a matter compliant with an IEEE standard for power over Ethernet (PoE). If the signature resistance is in a second range, information is received from the PD over the data cable and the existence of the PD is exposed by the PSE over a computer network. A command to control the PD is received by the PSE over the computer network and a power signal is provided to the PD from the PSE based on the command and the received information.

22 Claims, 5 Drawing Sheets

(56) References Cited

U.S. PATENT DOCUMENTS

| | | | | |
|---|---|---|---|---|
| 2015/0195883 | A1 | 7/2015 | Harris et al. | |
| 2017/0238392 | A1 | 8/2017 | Shearer et al. | |
| 2018/0129257 | A1 | 5/2018 | Stewart | |
| 2018/0139823 | A1 | 5/2018 | Hick et al. | |
| 2018/0177026 | A1* | 6/2018 | Bowser ..... | H05B 47/11 |

OTHER PUBLICATIONS

Microsemi, Next-Generation PoE: IEEE 802.3bt, 2016, retrieved from https://www.microsemi.com/document-portal/doc_view/136209-next-generation-poe-ieee-802-3bt-white-paper on Mar. 23, 2019.

Schindler, Fred, Link Layer Discovery Protocol LLDP, Jan. 2015, retrieved from http://www.ieee802.org/3/bt/public/jan15/schindler_3bt_1_01_15.pdf on Mar. 23, 2019.

Wikipedia, Power Over Ethernet, May 23, 2019, Retrieved from https://en.wikipedia.org/w/index.php?title=Power_over_Ethernet&diff=898449968&oldid=894957528 on Aug. 22, 2019.

Young, Bruce, Reply to Ex Parte Quayle Action in Related Case U.S. Appl. No. 16/523,805, Jan. 20, 2020.

* cited by examiner

REMOTE DIMMING OF LIGHTING

CROSS-REFERENCE TO RELATED APPLICATIONS

This application claims the benefit of U.S. Provisional Application 62/843,949 filed May 6, 2019 which is hereby incorporated by reference in its entirety herein for any and all purposes.

BACKGROUND

Technical Field

The present subject matter relates to lighting, and more specifically, to control of lighting by a remote power source.

Background Art

Circuitry to dim lighting is well known and has been widely used for many years. Traditional light sources, such as incandescent light bulbs, could be dimmed using a phase-cut dimmer. Such dimmers are widely available and are commonly installed in a lighting circuit in place of a traditional on/off switch. Phase-cut dimmers are typically triac-based and come in various topologies and designs, but they work by cutting off a portion of the alternating-current (AC) waveform to reduce the energy delivered to the light bulb. This worked every well for incandescent bulbs which effectively integrate the AC waveform and have a slow response time which eliminates any flickering. Lighting based on light-emitting diodes (LEDs), however need to include special circuitry to detect the intended dimming level of a traditional phase-cut dimmer to be able of function properly. Some LED drivers are designed to detect the amount of phase-cut on the AC line and then control the brightness of the LEDs using a variable current or a pulse-width modulated signal.

Other techniques for controlling the brightness level of LED-based lighting are also known. Some systems use an analog control signal to communicate a brightness level to an LED driver, such as a signal that varies from 0 volts (V) to turn the lighting off, to 10 V to turn set the lighting to full brightness. Another technique uses a digital addressable lighting interface (DALI) which is a two-way communication system with defined commands for LED drivers. This allows a controller to communicate with individual LED drivers and set the desired brightness level.

Regardless of how the dimming level is controlled, using a phase-cut dimmer on the AC power or using an analog signal or digital messages to the LED driver, there are two basic ways to control the brightness of an LED itself. In one approach, referred to as constant voltage (CV) dimming, an LED load is designed to receive specific DC voltage and a CV-based LED driver will provide whatever current will flow through the LED or LED array being driven. The other approach to drive an LED load is the constant current (CC) method, where the LED driver has a fixed current and will let the voltage level rise of fall dependent upon the LED load.

Brightness of the LED can be controlled by modulating the power delivered by the driver to the LED load. Because LEDs have a non-linear response to voltage, analog modulation of the voltage for dimming is not commonly used with a CV driver. To dim an LED load with a CV driver, the voltage is commonly modulated using pulse width modulation (PWM) or pulse density modulation (PDM), both of which affect the percentage of a given time period that the voltage is applied to the LED load which digitally modulates the power delivered. The time period is typically chosen to be short enough that most people can't detect any flickering, such as 16 milliseconds (ms) or less, with the PWM or PDM modulation being performed for each time period. So for example if a 25% brightness is desired, a PWM system may repeatedly turn the voltage on for 4 ms and then turn off the voltage for 12 ms before turning the voltage back on again and repeating.

While a CC driver can use PWM or PDM to modulate the current delivered to the LED load, it is common for a CC driver to dim the LED load by changing the DC current level delivered to the LED load, which is an analog modulation of the power delivered. This technique for dimming an LED has an advantage over PWM and PDM it eliminates high frequency flicker from the LED's that can cause health issues such as migraines.

Traditionally, LED drivers receive the incoming power from an AC mains line or in rare cases from a Direct Current source. One emerging trend for DC distribution for information technology (IT) equipment, telephones, cameras, and more recently, lighting, is power over Ethernet (PoE). PoE comes in several flavors that mainly are differentiated by power capacity. The Institute of Electrical and Electronics Engineering (IEEE) standard 802.3af was the first PoE standard to be adopted. It specified a way to provide Ethernet data and power up to 15.4 watts (W) through a single cable which was ideal for telephones. IEEE 802.3at come later with capacity up to 30 W and most recently IEEE 802.3bt allows up to 100 W to be provided at voltages up to 57 V. There are also proprietary flavors of PoE such as Cisco Systems' UPoE, Linear Technology's LTPoE, and Microsemi's PowerDsine solution. Devices that source PoE power are known as power sourcing equipment (PSE) and a device that consumes PoE power is known as a powered device (PD).

Some PSEs simply provide a set amount of power at all times, with no negotiation, which may be referred to as passive PoE. Passive PoE is simple and inexpensive but can lead to situations where a PD and PSE are not compatible with each other with no indication of an error other than the fact that the PD does not operate properly. In some cases, this can even lead to damage to the PSE or PD. A PD that is compliant with IEEE PoE standards includes a 25 kΩ (kilohm) resistor between the powered pairs. Additional information about the power requirements of a PD may be determined providing a classification voltage to the PD and measuring the resultant current, and/or by using Link Layer Discovery Protocol (LLDP) over the Ethernet connection to determine the power requirements of the PD.

BRIEF DESCRIPTION OF THE DRAWINGS

The accompanying drawings, which are incorporated in and constitute part of the specification, illustrate various embodiments. Together with the general description, the drawings serve to explain various principles. In the drawings.

DETAILED DESCRIPTION

Figure 1:
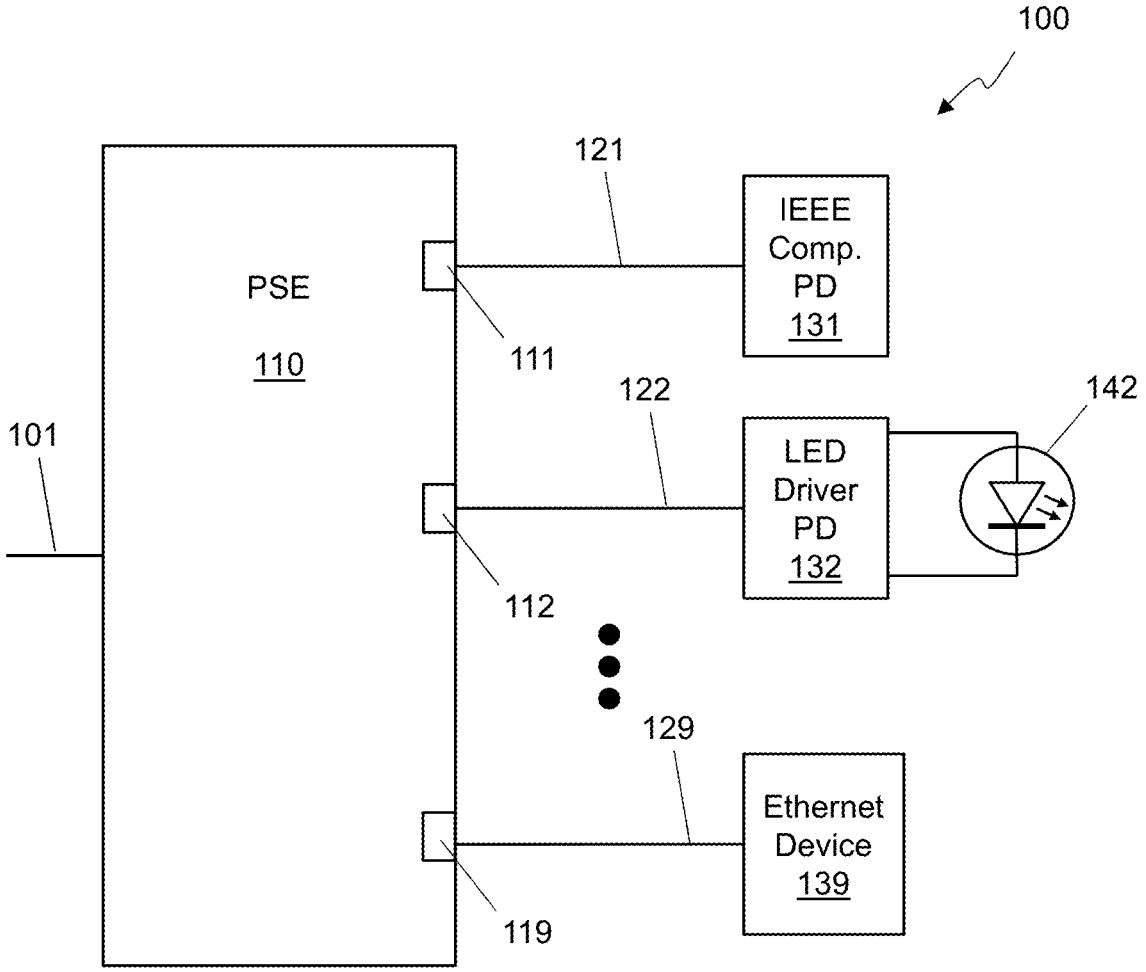
FIG. 1 shows a block diagram of an embodiment of a power-over-Ethernet (PoE) system.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures and components have been described at a relatively high-level, without detail, in order to avoid unnecessarily obscuring aspects of the present concepts. A number of descriptive terms and phrases are used in describing the various embodiments of this disclosure.

Embodiments are described herein that allow an Ethernet switch, router, or other equipment, to be configured to be compliant with IEEE power-over-Ethernet (PoE) standards such as 802.3af, 802.3at, and 802.3bt as power sourcing equipment (PSE) but provide an additional capability to power and control LED lighting loads by directly providing the power for the LEDs. This means that the module connecting to the PoE cable may not include power conversion and/or complicated control circuitry and may be able to directly provide the power from the PoE cable to the LEDs themselves. In some embodiments, the LED lighting load may not include a data connection to the Ethernet network, so that all of the intelligence to expose the LED light to the network and respond to network control of the LED light is handled in the PSE. This may allow for a much lower-cost device than solutions utilizing a traditional networked LED driver as is common in commercial installations today.

Embodiments may be included into a traditional PoE PSE Ethernet switch and may support IEEE standards-compliant PDs in addition to PDs consistent with the disclosures herein, but other embodiments may not support IEEE compliant PoE PDs. In some embodiments, the device driving the PoE cables may not include Ethernet switching capability at all, but may simply expose the lighting devices to the network as a network end-point and control the lighting devices by the amount of power provided to the cables connecting the lighting device to the PSE.

Ethernet switches or other devices acting as PSE should be compliant with appropriate IEEE standards, such as 802.3af, 802.3at, and 802.3bt, to determine how much power can be provided and whether to provide that power on 2 pairs of wires of the Ethernet cable or on all 4 pairs of wires. While the appropriate IEEE standards should be consulted for a full description of how the power negotiation is performed, a quick overview is presented here. An IEEE compliant PSE initially detects whether or not the PD has a signature resistance between PoE power pins of 19-26.5 (using a voltage of 2.7V-10.1V). If the PD has a valid signature resistance, the PSE applies a classification voltage of 14.5V-20.5V and detects the current drawn by the PD to determine a power class for the PD. In addition, communication over the Ethernet connection at the link layer using LLDP may be used for higher power classes defined by IEEE 802.3bt. As of the time of this filing, 8 power classes are defined for PoE PDs by IEEE specifications.

The inventor realized that by providing a different signature resistance, it would be possible to have a PD that did not indicate IEEE compliance and yet provide other mechanisms for the PD to provide its characteristics to the PSE. This allows the PSE to provide specialized support for the PD while still (optionally) being fully compliant with IEEE standards for PoE. As one example, the PSE may determine that the PD is an LED load and provide a constant current (CC) or constant voltage (CV) drive signal for the LED(s) over the Ethernet cable and also may modulate that signal using PWM, PDM, or analog modulation to control the brightness of the LED(s). While it might be possible to provide similar information using LLDP or other data communication over Ethernet between the PD and the PSE, that may add significant complexity and cost over other embodiments disclosed herein.

In some embodiments, the PSE may utilize a standard PSE integrated circuit with additional logic to manage the non-standard devices, but in other embodiments, both standards-compliant PoE and specialized PoE can be implemented using a standard microcontroller (MCU) or other processor. By adding a proprietary extension to an IEEE 802.3 compliant PoE switch it may be possible to reuse the power limiting features of the PSE or dedicated MCU to dim individual LED loads directly from the switch. This eliminates the redundancy of having to receive PoE power decoupled from the LED driver circuit and performing DC-to-DC conversion in the PD and allows a "driverless" end point at a PD functioning as a luminaire, saving significant cost and yielding better efficiency. The PSE could still be a fully IEEE compliant and operate as a standard PoE switch or router when used with compliant PoE PD loads, but allow the extension to operate as CC LED dimmer for individual ports coupled to a custom LED load. As the PoE standard requires individual classification by port, a special PoE switch could offer a hybrid mode where some ports are connected to LED loads (or other custom PoE loads) and others to standard PoE compliant devices.

An embodiment of a PD consistent with this disclosure may include a detection resistor outside of the valid 19-26.5 kΩ range specified by IEEE PoE standards to indicate that it is not standards compliant. Non-limiting examples of a detection resistor used by a PD consistent with this disclosure include, but are not limited to, 1 kΩ, 10 kΩ, 50 kΩ, and 100 kΩ. In some embodiments, no detection resistor is included, creating a high impedance across the power wires of the PoE Ethernet cable. As long as the non-compliant PD does not have a detection resistor of 19-26.5 kΩ the PD will not be presumed to be compliant with IEEE PoE standards.

An Ethernet cable used for PoE (e.g. a category 5, category 5e, category 6, or category 7 cable) contains 4 twisted pairs of wires that are typically 20-24 AWG. 10/100BASE-T Ethernet (10/100 Mb Ethernet) only utilizes 2 of the 4 twisted pairs for data communication, while 1000BASE-T (Gb Ethernet) uses all 4 pairs for data communication. Depending on the PoE power classification, two or four pairs may be used for power. Given the fact that 2 pairs are not used for 10/100BASE-T communication, and even for the auto-negotiation phase on a Gb port, the 2 unused pairs may be used as an alternative communication path for a proprietary PD, such as an LED-driver module. Other embodiments may use the same wire pairs as used for Ethernet communication, but using a different protocol. Any type of communication protocol may be used for the communication between the PD and the PSE consistent with this disclosure, such as, but not limited to, RS-232, RS-422, RS-485, basic universal asynchronous receiver-transmitter (UART) protocols, inter-integrated circuit ($I^2C$), universal serial bus (USB), other full-duplex or half-duplex bidirectional serial protocols, unidirectional serial protocols, parallel communication protocols, combinations of pre-determined voltage levels on the wires of the cable, or any other type of communication between the PD and the PSE.

Depending on the embodiment, the PSE could determine that the detection resistor of the PD is outside of the 19-26.5 kΩ range and then attempt to communicate with the PD using the pre-established non-standard communication protocol on the unused pairs, or first try to communicate with the PD using the pre-established non-standard communication protocol and then if no communication can be established, go through the IEEE PoE configuration procedure.

Any amount or type of information may be provided by the PD to the PSE using the non-standard communication protocol, depending on the embodiment, but a PD acting as an LED driver may communicate a CV voltage level or CC current level to be used to drive the LED(s). The LED driver may also communicate other information, such as information about which wire pairs on the PoE cable are used, information about different LEDs coupled to different wire pairs, minimum and/or maximum allowable current and/or voltage levels, brightness vs voltage relationships (e.g. curves or tables), brightness vs current relationships, or any other information related to the PD or external device (e.g. LEDs or LED arrays) coupled to the PD. In some embodiments, a PD coupled to an LED array with different color LEDs coupled to different wire pairs, such as a luminaire with red LEDs coupled to a first wire pair, green LEDs coupled to a second wire pair, blue LEDs coupled to a third wire pair, and white LEDs coupled to a fourth wire pair, may provide information about the configuration to the PSE which can then control the color of the luminaire by the ratio of the currents provided on the different wire pairs. In another example, information indicating that cool white LEDs (e.g. 5000K) are coupled to two of the wire pairs and warm white LEDs (e.g. 2700K) are coupled to the other two wire pairs may be provided to the PSE which allows the PSE to control a color temperature of the white light from the luminaire.

Information to be provided by the PD can be programmed into the PD at the factory during manufacturing, after manufacturing but before installation, at installation, or even after installation, using any technique, including, but not limited to, programming a non-volatile memory and including that in the PD, installing one or more resistors with particular valuables representing various information, setting jumpers or switches on the PD, or having code in a processor of the PD that can query an attached LED array to determine information about the array. In some embodiments, a non-volatile memory of the PD may be programmed in-situ. This can be done using any technique, including, but not limited to, sending the information to be programmed into the non-volatile memory to the PD and having circuitry on the PD program the non-volatile information, using a test fixture to program the non-volatile memory on the PD, or using a radio-frequency identification (RFID) signal to program an RFID tag (e.g. a near field communication (NFC) tag or other type of RFID tag) which acts as the non-volatile memory on the PD.

After receipt of the information from the PD, the PSE may control the PD based on the information received. In addition, the PSE may expose the PD as a device on a network, which may be the Ethernet network switched by the PSE, based on the information received. In some embodiments, the PSE may expose an individual PD as a device on the network, but in other embodiments the PSE may aggregate multiple PDs into a single entity to be exposed on a network. If the network utilizes internet protocol (IP), an IP address may be allocated for each individual PD, an aggregate of PDs, or as functions within the PSE which may have its own IP address. Any discovery protocol may be used to expose the device and its capabilities to other devices on the network, including, but not limited to, IP-based discovery protocols such as universal plug-and-play (UPnP), simple service discovery protocol (SSDP—which uses UPnP protocols), multicast domain name service (mDNS), or AllJoyn (which utilizes mDNS). Any data structure, protocol, or technique can be used to specify the functionality and control parameters of the PD through the discovery service, including, but not limited to, DotDot from the Zigbee Alliance, lightweight machine-to-machine protocol (LWM2M) from the Open Mobile Alliance (OMA), specifications from the Open Connectivity Foundation (OCF), Mesh Objects, JavaScript Object Notation (JSON) objects, eXtensible Markup Language (XML) objects, other standards, data structures, or mechanisms, or combinations thereof. Once the existence and capabilities of the PD are exposed on the network, other applications, devices, or entities may control the PD through the PSE, but the exact mechanisms used to do that, which may be standards-based or proprietary, are beyond the scope of this disclosure, although examples might include the ability to turn the LEDs coupled to the PD on or off, set a brightness level of the LEDs, control a color or color temperature of the LEDs or query a status of the LEDs.

In some embodiments, the PSE may be coupled to an emergency power source, which may be centralized or distributed, and may control the lighting PDs as a part of an emergency lighting system. In some cases, some PDs may have their own battery and the PSE may be able to receive power from the battery of a PD and send it to another PD, either because it does not have a battery or because its battery has been depleted.

While configuring a lighting device as a PD is discussed at length herein, other types of devices may be coupled to a PSE as a PD in some embodiments, such as various sensors (e.g. temperature sensors, gas sensors, water sensors, contact sensors, or any other type of sensor), USB wall-plugs as disclosed in provisional patent application 62/822,329 filed on Mar. 22, 2019 which is incorporated by reference herein, amplified speakers, information technology (IT) equipment, or any other type of device.

Reference now is made in detail to the examples illustrated in the accompanying drawings and discussed below.

FIG. 1 shows a block diagram of an embodiment of a power-over-Ethernet (PoE) system 100. The system 100 includes power sourcing equipment (PSE) 110 coupled to a computer network 101. The computer network 101 may be any type of computer network, but in some embodiments the computer network 101 may be an Ethernet network such as, but not limited to, a 10BASE-T, a 100BASE-T, or a 1000BASE-T network that utilizes a data cable with 4 pairs of wires. The data cable may be known as a category 3, a category 5, a category 5e, a category 6, or a category 7 cable in some embodiments. The data cable may utilize wires having any size but some embodiments, may use wire with 20-24 AWG and the data cable may be shielded or unshielded.

The PSE 110 includes one or more connectors 111-119 which may be used to couple to other devices 131-139 using data cables 121-129. The connectors 111-119 may be any type of connector, but in some embodiments, the connectors

111-119 are RJ-45 connectors as specified for 10/100/1000BASE-T networks. The PSE 110 may include Ethernet router, switch or hub functionality in some embodiments but in other embodiments, the PSE 110 may be a mid-point device which simply injects power on the data cables 121-129 without impacting the data communication. In at least one embodiment, the PSE 110 is an end point device which terminates the network 101 and simply provides power to other devices 131-139.

Devices 131-139 coupled to the PSE 110 may be a device 139 which does not use power from its data cable 129, a device which is a powered device (PD) 131 compliant with an IEEE PoE standard, or a powered device 132 which is non-compliant with an IEEE PoE standard. The devices 131-139 may implement any function and may connect to the Ethernet network provided from the PSE 110. In some embodiments, however, the PD 132 may not include circuitry to connect to the Ethernet network and may simple communicate with the PSE 110 over the data cable 122 using other communication protocols.

In some embodiments, the PD 132 may be coupled to one or more LEDs 142 or may include one or more LEDs 142. As the term is used herein, an LED may be a traditional light emitting diode, an organic light emitting diode, or any other type of solid-state device which emits light dependent upon an amount of current passing through it. In at least one embodiment, the PD 132 may include a circuit board that includes an RJ-45 socket (i.e. a female connector) to couple to data cable 122. The circuit board of PD 132 may include a non-volatile memory which may be an RFID tag that is programmed with information related to the LED 142, such as a CC drive current or a CV drive voltage.

Figure 2:
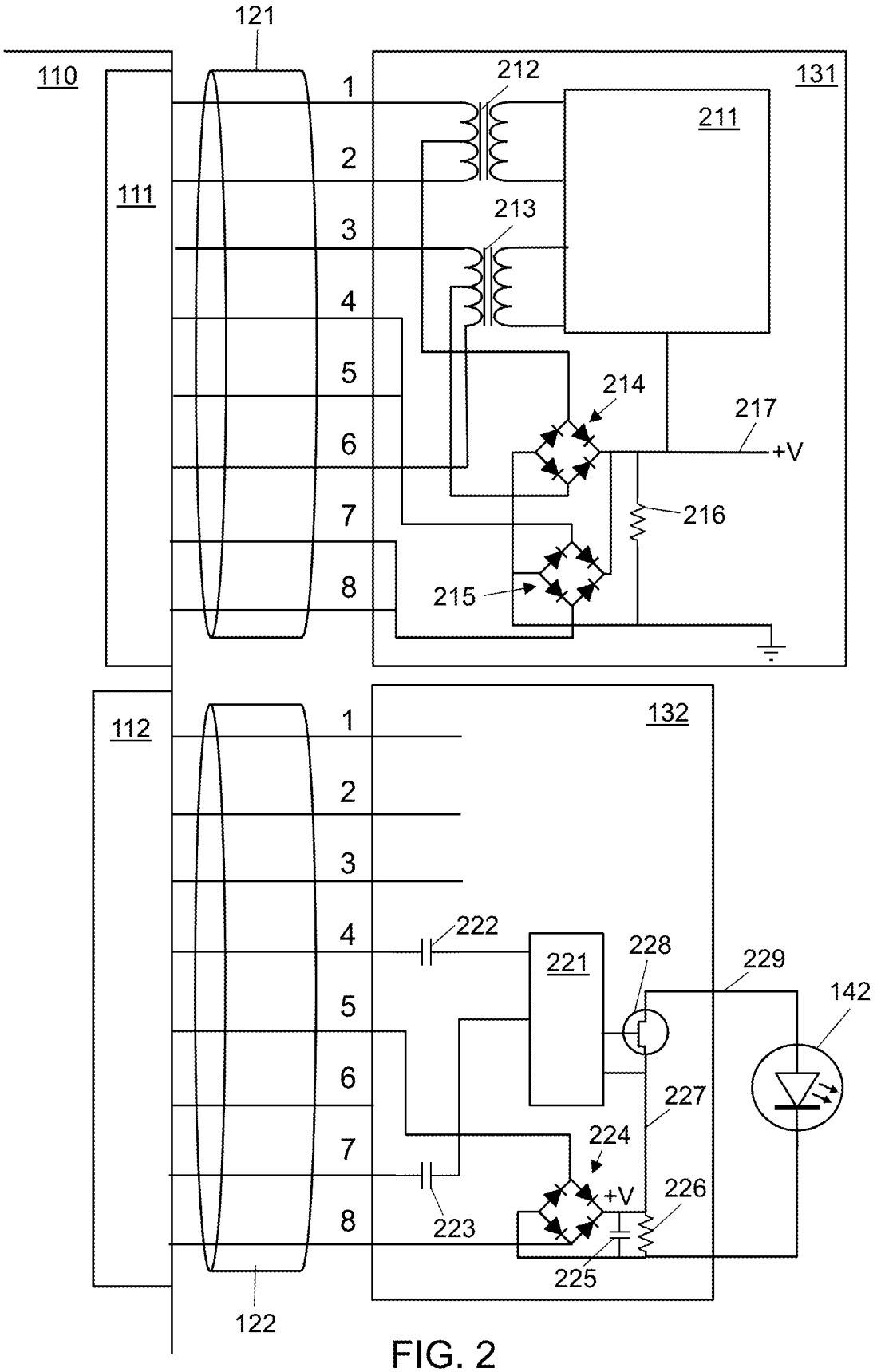
FIG. 2 shows a more detailed block diagram of embodiments of two powered devices (PDs) of the PoE system.

FIG. 2 shows a more detailed block diagram of a portion of an embodiment of the system 100 including additional detail about PD 131 which is compliant with an IEEE PoE standard and PD 132 which is not compliant with an IEEE PoE standard, which means that it does not fully implement the negotiation defined in those standards for determining how much power the PD 132 is requesting. PSE 110 includes a connector 111 coupled to a data cable 121 which has 4 twisted pairs of wires. While other wiring schemes may be used in embodiments, one pair of wires of cable 121 is coupled to pins 1 and 2 of connector 111, a second pair of wires of cable 121 is coupled to pins 3 and 6 of connector 111, a third pair of wires of cable 121 is coupled to pins 4 and 5 of connector 111, and a fourth pair of wires of cable 121 is coupled to pins 7 and 8 of connector 111.

A 10/100BASE-T Ethernet network utilizes two pairs of wires on an Ethernet cable, the pair connected to pins 1 and 2 and the pair connected to pins 3 and 6. While the other pins (4, 5, 7, and 8) are used for data communication by 1000BASE-T networks (which use all 4 twisted pairs on the cable for data communication), 10/100BASE-T networks do not. The PD 131 includes an Ethernet device 211 that couples to the first pair of data communication wires through transformer 212 and the second pair of data communication wires through transformer 213. The Ethernet device 211 may implement any functionality, including, but not limited to, a wireless access point, a printer, another network switch/router, a camera, a voice-over-IP (VOW) phone, an IP television (IPTV) set-top box (STB), or a networked LED driver.

IEEE PoE standards define mechanisms to send power over the data cable 121. Various configurations are defined, including sending power over the wire pairs unused by 10/100BASE-T (pins 4, 5, 7, and 8), power over the wire pairs used for data communication (pins 1, 2, 3, and 6), or all 4 pairs of wires on the data cable 121. The PD 131 includes additional circuitry to enable the PSE 110 to determine that the PD 131 is compliant with an IEEE PoE standard. The circuitry may include a signature resistor 216 that may have a nominal resistance of 25 kΩ which is used to indicate to the PSE 110 that the PD 131 is compliant. In the embodiment shown, the circuitry also includes two full-wave rectifiers 214-215 which allow power on the first two pairs (1, 2, 3, 6), second two pairs (4, 5, 7, 8), or all four pairs to be received by the PD 131 and provided as a positive voltage 217 to power the PD 131, which may include the Ethernet device 211. In embodiments, the PD 131 may have additional circuitry to allow a particular class of power to be requested from the PSE 110 consistent with the IEEE PoE standards. In addition, the Ethernet device 211 may be able to communicate with the PSE 110 using LLDP to further specify power requirements to the PSE 110.

PD 132 is an embodiment of an LED driver device which is not compliant with IEEE PoE standards. PD 132 is coupled to the RJ-45 connector 112 of the PSE 110 using a standard Ethernet cable (e.g. category 3, 5, 5e, 6, or 7). Note that PD 132 in this embodiment does not include an Ethernet device and does not communicate using Ethernet protocols. PD 132 may be configured to accept power only on a particular set of wires of the cable 122, such as pins 5 and 8 in the example shown. Other PD devices may be able to accept power over any other combination of wires of the cable 122, including configurations of wires which are consistent with IEEE PoE standards as described above.

The PD 132 includes a mechanism to inform the PSE that it is not compliant with IEEE PoE standards but still is requesting power be provided using a mechanism that is not standards compliant. Any mechanism can be used for this, but some embodiments may include a signature resistor 226 that is outside of the 19 kΩ-26.5 kΩ signature resistance used by IEEE PoE standards. Any resistance value outside of that range may be used in embodiments, including resistances less than 19 kΩ, such as 15 kΩ, or 10 kΩ, and resistances above 26.5 kΩ, such as 30 kΩ, 50 kΩ or 75 kΩ. In some embodiments a signature resistor 226 of about 100 kΩ may be used to signify that the PD 132 is requesting non-standard power delivery over the cable 122 consistent with this disclosure.

The PD 132 may also include circuitry 221 to communicate information about the PD 132 and/or an externally coupled device (e.g. LED 142) to the PSE 110. In some embodiments, the circuitry 221 may include a processor coupled to one or more wires of the cable 122 for communication with the PSE 110. In some embodiments, the circuitry 221 may be directly connected to the cable 122 through low-resistance conductors. In other embodiments, the circuitry 221 may be AC coupled to the wires of the cable 122 using capacitors 222, 223 or inductively coupled to the wires of the cable 122 using a transformer. The circuitry 221 may include jumpers, switches, or resistors that can be sensed to determine the information to send. As a non-limiting example, a PD 132 may offer support for a variety of different LED 142 loads, including 8 different predefined CC currents and 8 different predefined CV voltages which can be encoded by a 4 position dipswitch or as a jumper to indicate CC vs CV and a single resistor with one of 4 different resistance values that can be measured by the circuitry 221. In some embodiments, the jumpers, switches, and/or resistances may be determined by the PSE 110 over the cable 122 with minimal to no active circuitry 221 in the PD 132. In another embodiment, the circuitry 221 includes a non-volatile memory holding previously stored information which is then sent to the PSE 110. In at least one embodiment, the non-volatile memory is implemented as an RFID tag that has had the information stored into it by an RFID programmer using radio-frequency communication. A processor or other circuit within the circuitry 221 can read the information from the RFID tag and send it to the PSE 110 or in some embodiments, the RFID tag may be coupled to the cable 122 to allow the PSE 110 to directly read its contents.

The PD 132 may also include power circuitry to accept power provided by the PSE 110 over the cable 122. Depending on the embodiment, the circuitry may include diodes in various configurations, including the full-wave rectifier 224 shown, capacitors 225, voltage limiters, or other circuitry to generate one or more power supplies 227 within the PD 132. In embodiments, the circuitry 221 may be powered from one of the power supplies 227 generated from power supplied over the cable 122, although in other embodiments, the circuitry 221 may be powered by a battery or other power source inside or outside of the PD 132.

The circuitry 221 is configured to communicate with the PSE 110 and may use any protocol, standard or proprietary, for that communication, depending on the embodiment. In at least one embodiment, the circuitry 221 is low power circuitry that can function from the power provided by the PSE during the resistance detection as the resistance of the signature resistor 226 is being determined. In such cases, the current draw of the circuitry 221 may be taken into account for the selection of the resistor to be used for the signature resistor 226. For example, if the target resistance of the signature resistor 226 is 100 kΩ, and the circuitry 221 may consume 10 micro-amperes (μA) if the power supply 227 is at 5 V, a 125 kΩ resistor may be selected so that 50 μA of current is drawn by the PD 132 at 5V consistent with a 100 kΩ signature resistance. Care should also be taken to assure that even under the full range of compliant test voltages defined by IEEE PoE standards (2.7V-10.1V), the current drawn by PD 132 does not fall into the range of 19 kΩ-26.5 kΩ which indicates an IEEE compliant device.

Various embodiments may initiate the communication between the circuitry 221 of the PD 132 and the PSE 110 using various techniques. In some embodiments, the circuitry 221 may simply start sending the information as soon as it receives adequate power and the circuitry 221 may send it a predetermined number of times, such as once, twice, or 10 times, or may simply repeat sending it until a message is received telling the circuitry 221 to stop sending or power is lost. In other embodiments, the circuitry 221 may wait for a message from the PSE 110 before responding to the message with the information.

Any type of communication protocol may be used for the communication between the circuitry 221 and the PSE 110, including, but not limited to, standard communication protocols such as USB, RS-232, RS-485, $I^2C$, serial peripheral interface (SPI), Microwire, or 1-Wire, or non-standard serial or parallel interfaces such as a simple UART serial protocol or a multi-bit data bus with a 2 or 3 wire handshake.

In some embodiments, the circuitry 221 may control a switch 228 to enable a power supply 227 to provide power 229 to the load, such as LED 142. The switch 228 may include one or more of a field-effect transistor (FET), a silicon-controlled rectifier (SCR), a triode for alternating current (triac), a relay, or other component. In some embodiments, the circuitry 221 may operate at a lower voltage than a minimum activation voltage for the LED 142, so no switch 228 is used, although a separate voltage regulator or other voltage protection may be used for circuitry 221 to protect it from higher voltages that may be used to drive the LED 142 during operation.

Figure 3:
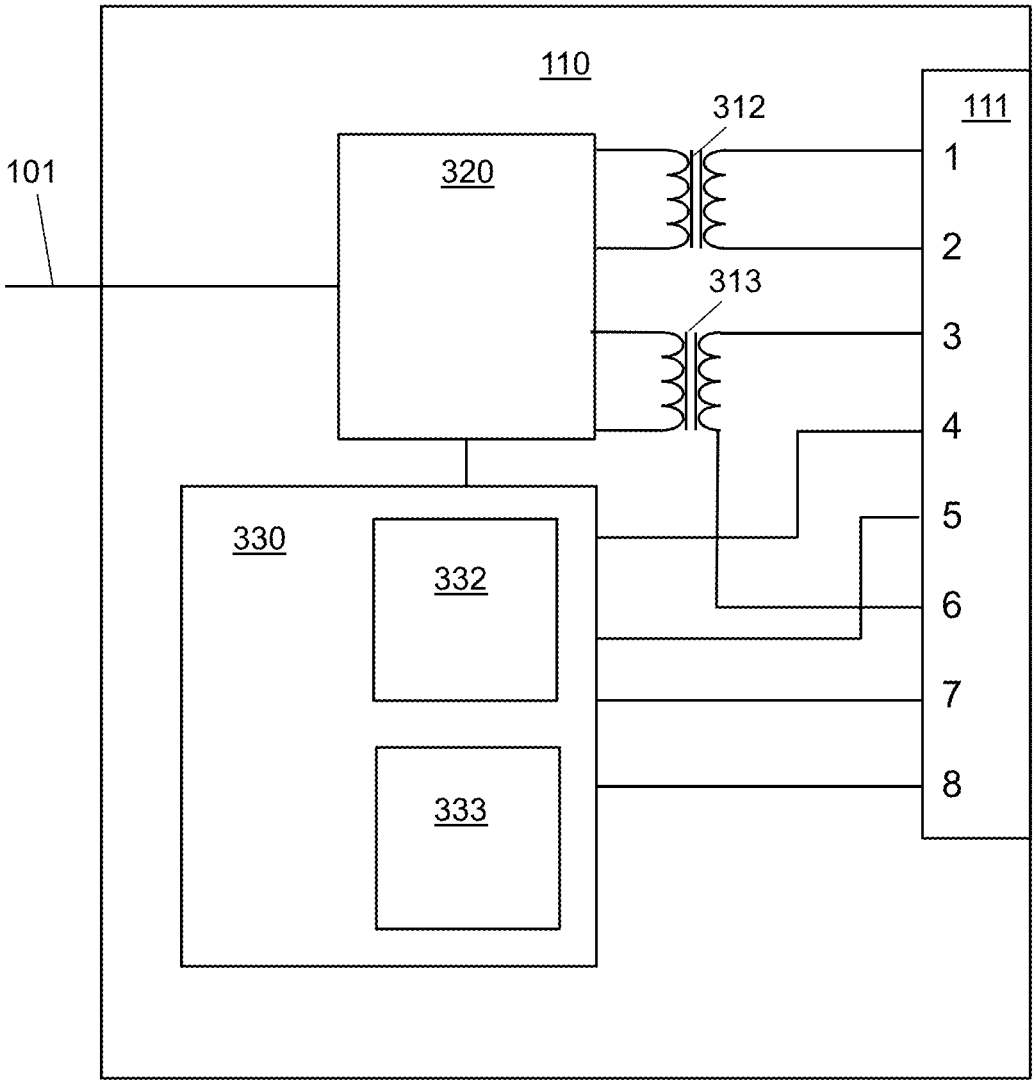
FIG. 3 shows a more detailed block diagram of an embodiment of power system equipment (PSE) of the PoE system.

FIG. 3 shows a more detailed block diagram of one port of an embodiment of power system equipment (PSE) 110 of the PoE system 100. The PSE 110 may include any number of ports which may be implemented independently or may share one or more of the components shown in FIG. 3. The PSE 110 has a connection to a network 101, which may be an Ethernet network in some embodiments, and has a connector 111 for the port shown, which may be an 8 contact RJ-45 socket in some embodiments. In some embodiments, the PSE 110 includes an Ethernet switch or router component 320 which can implement layer 2 or higher switching/routing functionality of the Ethernet network and may connect to any number of Ethernet ports. One port of the Ethernet component 320 is coupled to two pairs of contacts of the connector 111 using transformers 312, 313 compliant with 10/100BASE-T specifications.

The PSE 110 also includes PoE circuitry 330. While a connection to the two pairs of contacts of connector 111 that are not used for data is shown, other embodiments may connect to any number and any combination of contacts of the connector 111. The PoE circuitry 330 may include standards-compliant circuitry 332 which manages PoE in a way that is compliant with IEEE PoE standards. This may include the detection of a signature resistance and a determination of a class of power, among other requirements of the standards.

The PoE circuitry 330 also includes circuitry 333 to provide power to a PD that is not standards-compliant through the connector 111. In some embodiments, the circuitry 333 may be merged with circuitry 332 to serve both standards-compliant and non-compliant PDs. The circuitry 333 detects that the PD coupled to the connector 111 is not standards compliant yet is requesting power be provided over its cable. This may be done by any method but in some embodiments, it may be determined by providing a voltage across a pair of pins of the connector and detecting a particular range of current (i.e. detecting a signature resistance). In other embodiments, the circuitry 333 may simply listen for a message from the PD or may send a request for information to the PD using a simple communications protocol.

The circuitry 333 may also receive information about the PD through the connector 111. This information may include information about how to power the PD such as a CC drive current, a CV drive voltage, a maximum power draw, a duty-cycle requirement, a configuration of the PD or a load coupled to the PD, or any other information related to the PD or a load coupled to the PD, such as one or more LEDs coupled to the PD.

The PoE circuitry 330 may expose the existence of the PD to the network 101. This may be done through a port of the Ethernet component 320 and may utilize any protocol to advertise the existence of the PD and any capabilities of the PD based on the information received. The PoE circuitry may also receive commands from the network 101 to control the PD and use the circuitry 333 to send a power signal through the connector 111 to the PD based on the commands received through the network 101 and the information received from the PD.

Figure 4:
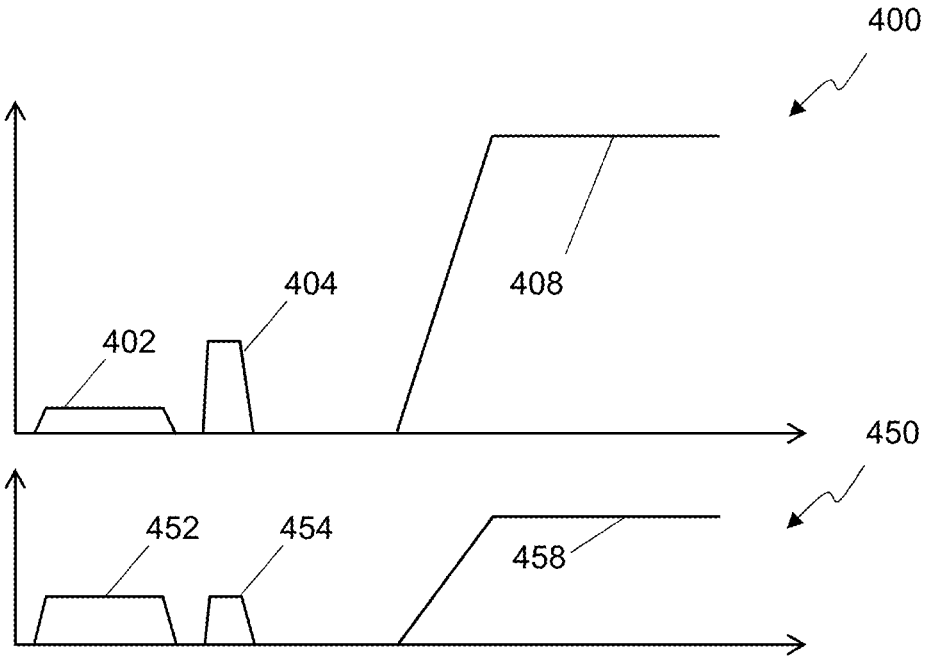
FIG. 4 shows waveforms of PoE negotiation for an IEEE compliant PD.

FIG. 4 shows waveforms of PoE negotiation for an IEEE compliant PD including a voltage waveform 400 and a current waveform 450. While the appropriate IEEE standards, such as IEEE 802.3af, IEEE 802.3at, and/or IEEE 802.3bt, should be consulted for a full description of how the negotiation is performed, a quick overview is presented here. An IEEE compliant PSE initially detects whether or not the PD has a signature resistance between PoE power pins of 19-26.5 kΩ. This is done by presenting a test voltage 402 of 2.7V-10.1V to the PD and detecting the current 452. If the PD has a valid signature resistance, the PSE applies a classification voltage 404 of 14.5V-20.5V and detects the current drawn by the PD 454 to determine a power class for the PD. Once the appropriate power class has been determined, the PSE may apply a voltage 408 of 44V-57V to the appropriate pins of the Ethernet cable to provide the requested amount of power to the PD. The current 458 may be limited by the power class negotiated.

Figure 5:
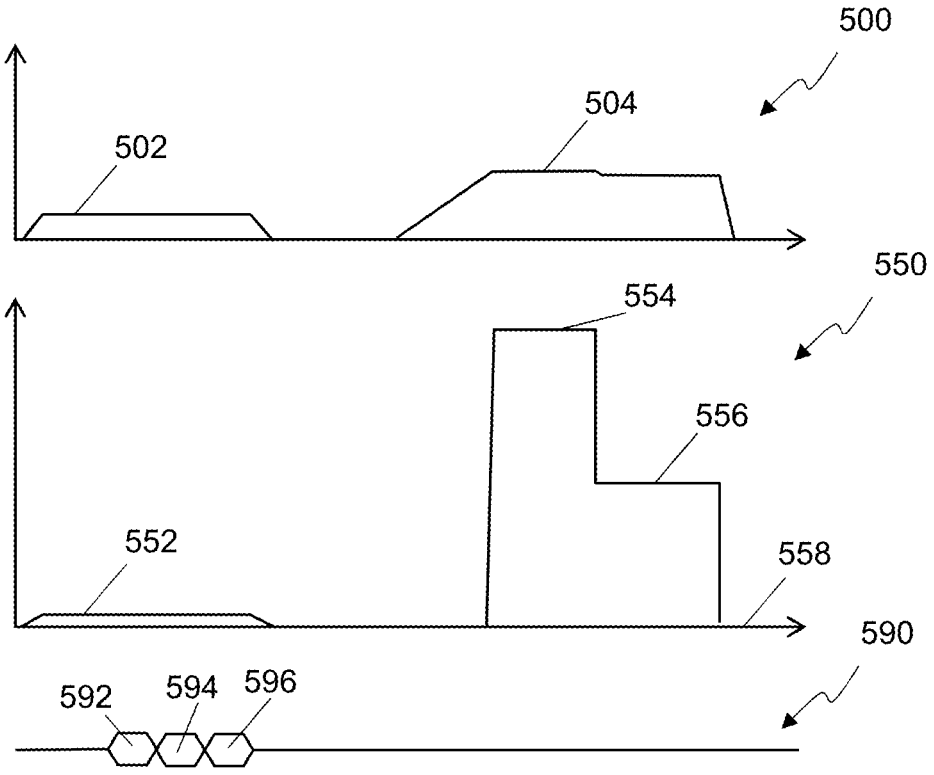
FIG. 5 shows waveforms of PoE negotiations for an embodiment of a PD that is consistent with IEEE PoE standards, but provides additional capability.

FIG. 5 shows waveforms of PoE negotiations for an embodiment of a PD that is consistent with IEEE standards, but provides additional capability, which may be referred to as being non-compliant with the IEEE standards. FIG. 5 shows voltage waveforms 500, current waveforms 550, and data waveforms 590. Depending on the embodiment, the data communication 590 may take place on the same wires as the voltage waveform 500 and current waveform 550 or may utilize different wires on the same cable. In the embodiment shown, the PSE starts by applying a test voltage 502 to the Ethernet cable in a manner consistent with IEEE standards for determination of the signature resistance. The current 552 is then detected to determine the signature resistance by dividing the voltage by the current. If the PD were a standards-compliant PD, the PSE might continue as shown in FIG. 4, but if the signature resistance is outside of the valid standards-compliant range, and in a range predetermined to invoke the non-standard PoE described here, communication between the PSE and the PD may commence.

The communication between the PSE and PD may vary depending on the embodiment, but in the embodiment shown, the PSE waits for a period of time after providing the test voltage 502 to allow the PD to receive power and wake up, then sends a request 592 to ask the PD to send information about the PD and/or its associated load to the PSE. The PD sends the information 594 to the PSE which may respond with an acknowledgement 596. In some embodiments, the acknowledgement may include configuration information such as information to turn on a switch to drive the attached load or other configuration information, although other embodiments may not utilize an acknowledgement 596.

The PSE may expose information related to the PD to a network and may receive commands for the PD, such as a command to turn on the luminaire represented by the PD to full brightness. The PSE may then provide a power signal represented by voltage waveform 504 to the PD over the Ethernet cable. Note that in the embodiment shown, the LED load does not turn on until the applied voltage 504 nears its peak value. Once the LED load turns on, the PSE may provide a full-on current level 554 as determined by the information that was received by the PSE. The PSE may receive a command to set the luminaire brightness to a 50% level at a later time. The PSE may then respond to this by setting the current level 556 to 50% of maximum. Note that the voltage may change very little when the current is cut in half due to the non-linear voltage behavior of an LED. The PSE may then receive a command to turn off the LED, causing it to set the current 558 to zero.

Aspects of various embodiments are described with reference to flowchart illustrations and/or block diagrams of methods, apparatus, systems, and computer program products according to various embodiments disclosed herein. It will be understood that various blocks of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and/or block diagrams in the figures help to illustrate the architecture, functionality, and operation of possible implementations of systems, methods and computer program products of various embodiments. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Figure 6:
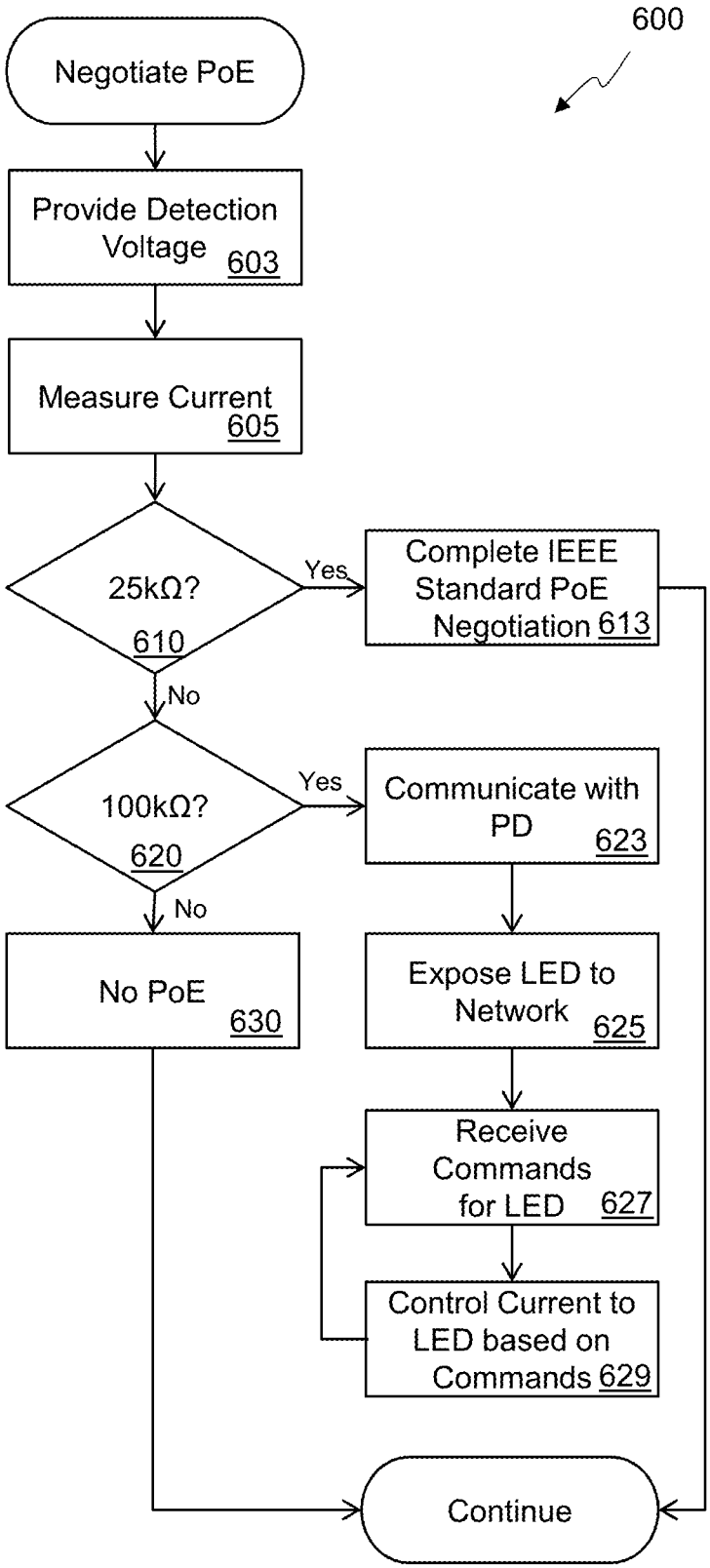
FIG. 6 is a flowchart of an embodiment of negotiating for an LED driver in a PoE system.

FIG. 6 is a flowchart 600 of an embodiment of negotiating a power request for an LED driver in a PoE system. The method of the flowchart 600 may be used in a device which may also provide Ethernet switching or routing, may be compliant with an IEEE PoE standard, and/or may act as a standalone device to provide power over data cables to one or more devices.

The flowchart 600 begins by providing a detection voltage 603 on a cable to another device, which may be referred to as a powered device (PD) herein. The PD may be compliant with an IEEE PoE specification or it may be consistent with the disclosures herein. The PD can implement any type of functionality, but it may include one or more LEDs or may be coupled to one or more LEDs in some embodiments. The detection voltage can be any voltage level, but in at least some embodiments, the detection voltage may be between about 2.8 V and about 10 V. In at least one embodiment, a 5V detection voltage may be used.

Once the detection voltage has been provided 603, a current provided to the PD may be measured 605. Based on the measured current, a signature resistance may be calculated for the PD. The value of the signature resistance may be useful in determining whether the PD is compliant with and IEEE PoE standard, compliant with the present disclosure, or whether the PD is not configured to accept power over the data cable. In some embodiments, the signature resistance is checked 610 to see if the PD is compliant with an IEEE PoE standard, which defines a nominal resistance of 25 kΩ to indicate compliance with the IEEE PoE standard. In some embodiments, if the signature resistance is found to be in a range the includes 25 kΩ, such as between 19 kΩ and 26.5 kΩ, the PD is determined to be compliant with an IEEE PoE standard and a PoE negotiation as defined by the appropriate IEEE PoE standard (e.g. 802.3af, 802.3at, or 802.3bt) may be performed 613 to determine the appropriate power to apply to the cable.

In embodiments, additional checks may be performed to determine 620 if the PD may be able to receive power as defined herein. These checks may take any form, depending on the embodiment, including, but not limited to, a signature resistance outside of the range specified by IEEE PoE standards, a pattern of pull-up and/or pull-down resistors on the wires of the cable, a pattern of connections between wires of the cable, receiving data sent from the PD, or receiving a signal with a particular frequency and/or duty cycle from the PD. If it is determined 620 that the PD is unable to receive power as disclosed herein, then no PoE is provided 630 to the PD.

In at least one embodiment, a signature resistance of nominally 100 kΩ (which may have a tolerance depending on the embodiment) may be used to indicate that a PD is capable of receiving power as described herein. So if it is determined 620 that the signature resistance is about 100 kΩ, communication 623 with the PD may occur to receive information from the PD. The information received from the PD can be any type of information related to the PD, but in at least one embodiment, the PD may be a luminaire and information about how to drive the luminaire, such as a constant voltage drive level, a constant current drive level, or any other type of information about the luminaire may be provided to the PD. Any communication protocol used for the communication with the PD, standards-based or proprietary, and may take place over the cable coupled to the PD. The data communicated can be formatted in any way, but in some embodiments, the data may be formatted as a JSON object, XML code, binary data, or human-readable text-based descriptions.

Once the information about the PD (which may be an LED device in some embodiments) has been received, the existence of the PD may be exposed 625 on a computer network. The PD may, in some embodiments, be exposed using a standard discovery protocol to allow it to be discovered and controlled by a variety of other devices. In other embodiments, the PD may be exposed to a proprietary application to allow that application to control the PD.

After the PD (which may be an LED driver in some embodiments) has been exposed, commands to control the PD may be received 627. In response to receiving the commands, the PD may be controlled 629 based on the received commands. In some cases, the received command may indicate a brightness level for an LED driver functioning as the PD. In some embodiments where the PD is an LED driver, the information received 623 may indicate that the LED driver utilizes a constant-current (CC) drive. In response, the PSE may calculate an appropriate amount of current for the brightness based on a maximum current level for the LED driver or a brightness vs current relationship for the LED driver, and the calculated amount of current may be provided through the cable to the PD to set the desired brightness of the LED(s). The amount of current may be based on a brightness level indicated by the received command along with information indicating a full-brightness current level for the LED(s) received from the PD. So as a non-limiting example, if information indicating the a current of 1 A would provide full brightness, and a command indicating that the LED(s) should be turned on at 50% brightness, a 500 mA signal may be provided to the LED driver though the cable. In some embodiments, the amount of current may be found using brightness vs current information which may be in the form of an equation (linear, polynomial, or other) or a table of values (which may have a complete set current values for each possible brightness level or current values for only some brightness levels which can then be interpolated).

In other embodiments where the PD is an LED driver, the information received 623 may indicate that the LED driver utilizes a constant-voltage (CV) drive and/or may indicate a voltage level to use. In response, the PSE may calculate a percentage of on time to use to provide the desired brightness level for the LED(s). In some cases a linear relationship between a brightness level as a percentage of full brightness and the on time percentage may be used but in other cases, a non-linear relationship may be used which may be predetermined by the PSE or may be based on information received from the LED driver. The PSE may then use the percentage of on time to generate the power signal using pulse-width modulation or pulse-density modulation and provide the power signal to the LED driver over the cable. As a non-limiting example, the LED driver may indicate that it is a CV driver and expects a 48V DC drive level. If a command is received indicating that the LED(s) should be turned on at a 50% brightness, a power signal with an amplitude of 48V and a 50% duty cycle at a given frequency, such as 120 Hz, may be provided to the LED driver through the cable.

Over time additional commands may be received 627 and the PD controlled 629 based on the received commands and the information received from the PD.

As will be appreciated by those of ordinary skill in the art, aspects of the various embodiments may be embodied as a system, device, method, or computer program product apparatus. Accordingly, elements of the present disclosure may take the form of an entirely hardware embodiment, an entirely software embodiment (including firmware, resident software, micro-code, or the like) or an embodiment combining software and hardware aspects that may all generally be referred to herein as a "server," "circuit," "module," "client," "computer," "logic," or "system," or other terms. Furthermore, aspects of the various embodiments may take the form of a computer program product embodied in one or more computer-readable medium(s) having computer program code stored thereon.

Any combination of one or more computer-readable storage medium(s) may be utilized. A computer-readable storage medium may be embodied as, for example, an electronic, magnetic, optical, electromagnetic, infrared, or semiconductor system, apparatus, or device, or other like storage devices known to those of ordinary skill in the art, or any suitable combination of computer-readable storage mediums described herein. In the context of this document, a computer-readable storage medium may be any tangible medium that can contain, or store a program and/or data for use by or in connection with an instruction execution system, apparatus, or device. Even if the data in the computer-readable storage medium requires action to maintain the storage of data, such as in a traditional semiconductor-based dynamic random access memory, the data storage in a computer-readable storage medium can be considered to be non-transitory. A computer data transmission medium, such as a transmission line, a coaxial cable, a radio-frequency carrier, and the like, may also be able to store data, although any data storage in a data transmission medium can be said to be transitory storage. Nonetheless, a computer-readable storage medium, as the term is used herein, does not include a computer data transmission medium.

Computer program code for carrying out operations for aspects of various embodiments may be written in any combination of one or more programming languages, including object oriented programming languages such as Java, Python, C++, or the like, conventional procedural programming languages, such as the "C" programming language or similar programming languages, or low-level computer languages, such as assembly language or microcode. The computer program code if loaded onto a computer, or other programmable apparatus, produces a computer implemented method. The instructions which execute on the computer or other programmable apparatus may provide the mechanism for implementing some or all of the functions/acts specified in the flowchart and/or block diagram block or blocks. In accordance with various implementations, the program code may execute entirely on the user's computer, partly on the user's computer, as a stand-alone software package, partly on the user's computer and partly on a remote computer or entirely on the remote computer or server, such as a cloud-based server. In the latter scenario, the remote computer may be connected to the user's computer through any type of network, including a local area network (LAN) or a wide area network (WAN), or the connection may be made to an external computer (for example, through the Internet using an Internet Service Provider). The computer program code stored in/on (i.e. embodied therewith) the non-transitory computer-readable medium produces an article of manufacture.

The computer program code, if executed by a processor causes physical changes in the electronic devices of the processor which change the physical flow of electrons through the devices. This alters the connections between devices which changes the functionality of the circuit. For example, if two transistors in a processor are wired to perform a multiplexing operation under control of the computer program code, if a first computer instruction is executed, electrons from a first source flow through the first transistor to a destination, but if a different computer instruction is executed, electrons from the first source are blocked from reaching the destination, but electrons from a second source are allowed to flow through the second transistor to the destination. So a processor programmed to perform a task is transformed from what the processor was before being programmed to perform that task, much like a physical plumbing system with different valves can be controlled to change the physical flow of a fluid.

Examples of various embodiments are described in the following paragraphs:

Embodiment 1

A method of providing power to a device over a cable, the method comprising: determining whether the device is able to receive power over the cable as specified by an open industry standard; in response to determining that the device is able to receive power over the cable as specified by the open industry standard, providing power to the device over the cable as specified by the open industry standard; in response to determining that the device is not able to receive power over the cable as specified by the open industry standard: receiving information from the device over the cable; exposing an existence of the device over a computer network; receiving a command for the device over the computer network; and providing a power signal over the cable to the device based on the command and the received information.

Embodiment 2

The method of embodiment 1, wherein the open industry standard is a standard published by an IEEE 802.3 committee.

Embodiment 3

The method of embodiment 2, wherein the cable is compliant with power over Ethernet (PoE) cable requirements in a standard published by the IEEE 802.3 committee.

Embodiment 4

The method of embodiment 3, said receiving the information from the device over the cable comprising: receiving data on wires of the cable that are not specified for use by 10/100BASE-T communication on the cable.

Embodiment 5

The method of embodiment 3 or 4, said determining whether the device is able to receive power over the cable as specified by the open industry standard comprising: attempting to communicate with the device using a protocol other than an Ethernet protocol over wires of the cable that are not specified for use by 10/100BASE-T communication on the cable; and in response to successful communication with the device using the protocol other than the Ethernet protocol over the wires of the cable that are not specified for use by 10/100BASE-T communication on the cable, determining that the device is not able to receive the power over the cable as specified by the open industry standard.

Embodiment 6

The method of embodiment 5, wherein the information is received during the successful communication with the device using the protocol other than the Ethernet protocol over the wires of the cable that are not specified for use by 10/100BASE-T communication on the cable.

Embodiment 7

The method of any of embodiments 3-5, said determining whether the device is able to receive power over the cable as specified by the open industry standard comprising: attempting to communicate with the device using a protocol other than an Ethernet protocol over wires of the cable that are not specified for use by 10/100BASE-T communication on the cable; in response to an inability to communicate with the device using the protocol other than the Ethernet protocol over the wires of the cable that are not specified for use by 10/100BASE-T communication on the cable: detecting a signature resistance of the device through the cable; and determining that the signature resistance is in a first range to indicate that the device is able to receive the power over the cable as specified by the open industry standard.

Embodiment 8

The method of embodiment 1, said determining whether the device is able to receive power over the cable as specified by the open industry standard comprising: detecting a signature resistance of the device through the cable; and determining that the signature resistance is in a first range to indicate that the device is able to receive the power over the cable as specified by the open industry standard.

Embodiment 9

The method of embodiment 1 or 8, said determining whether the device is able to receive power over the cable as specified by the open industry standard comprising: detecting a signature resistance of the device through the cable; and determining that the signature resistance is in a second range to indicate that the device is not able to receive the power over the cable as specified by the open industry standard and is able to provide additional the information about the device's ability to receive the power signal over the cable.

Embodiment 10

The method of embodiment 1, 8 or 9, said receiving the information from the device over the cable comprising: measuring two or more resistances between wires of the cable; and determining the information based on the two or more resistances.

Embodiment 11

The method of any of embodiments 1-10, further comprising:

obtaining a brightness level for a lighting element of the device from the command; determining a drive characteristic for the lighting element based on the information; and generating the power signal based on both the brightness level and the drive characteristic.

Embodiment 12

The method of embodiment 11, the device comprising an LED driver.

Embodiment 13

The method of embodiment 11 or 12, further comprising: calculating a percentage of on time of the power signal based on the brightness and the drive characteristic indicating that the lighting element utilizes a constant voltage drive signal; and using the percentage of on time to generate the power signal using pulse-width modulation or pulse-density modulation.

Embodiment 14

The method of any of embodiments 11-13, further comprising: calculating a current level for the power signal is on based on the brightness and the drive characteristic indicating that the lighting element utilizes a constant current drive signal; and generating the power signal with the calculated current level.

Embodiment 15

The method of any of embodiments 11-13, further comprising: calculating a current level for the power signal is on based on the brightness and the drive characteristic indicating a brightness vs current relationship for the lighting element; and generating the power signal with the calculated current level.

Embodiment 16

A method of driving a lighting load, the method comprising: receiving a drive characteristic for the lighting load over a cable coupled to the lighting load; receiving a brightness level for the lighting load over a computer network; generating a power signal based on both the brightness level and the drive characteristic; and providing the power signal to the lighting load over the cable.

Embodiment 17

The method of embodiment 16, further comprising: calculating a percentage of on time of the power signal based on the brightness and the drive characteristic indicating that the lighting load utilizes a constant voltage drive signal; and using the percentage of on time to generate the power signal using pulse-width modulation or pulse-density modulation.

Embodiment 18

The method of embodiment 16, further comprising: calculating a current level for the power signal is on based on the brightness and the drive characteristic indicating that the lighting load utilizes a constant current drive signal; and generating the power signal with the calculated current level.

Embodiment 19

The method of embodiment 16, further comprising: calculating a current level for the power signal is on based on the brightness and the drive characteristic indicating a brightness vs current relationship for the lighting element; and generating the power signal with the calculated current level.

Embodiment 20

The method of any of embodiments 16-19, further comprising: receiving information related to standards compliance from the lighting load over the cable; and determining whether to provide the power signal to the lighting load over the cable in response to the received information.

Embodiment 21

The method of any of embodiments 16-20, wherein the cable is compliant with power over Ethernet (PoE) cable requirements in a standard published by an IEEE 802.3 committee.

Embodiment 22

The method of embodiment 21, said receiving the drive characteristic comprising: receiving data on wires of the cable that are not specified for use by 10/100BASE-T communication on the cable using a protocol other than an Ethernet protocol.

Embodiment 23

The method of any of embodiments 16-22, said receiving the drive characteristic comprising: measuring two or more resistances between wires of the cable; and determining the drive characteristic based on the two or more resistances.

Embodiment 24

The method of any of embodiments 16-23, the lighting load comprising an LED driver.

Embodiment 25

A method of driving a lighting load, the method comprising: providing information based on a drive characteristic of the lighting load over a cable; providing a power signal from the cable; and providing the power signal to the lighting load.

Embodiment 26

The method of embodiment 25, wherein the cable is compliant with power over Ethernet (PoE) cable requirements in a standard published by an IEEE 802.3 committee.

Embodiment 27

The method of embodiment 26, said providing the information comprising: sending data on wires of the cable that are not specified for use by 10/100BASE-T communication on the cable using a protocol other than an Ethernet protocol.

Embodiment 28

The method of embodiment 26 or 27, further comprising providing a signature resistance in a predetermined range outside of a range of 19 kΩ-26.5 kΩ as measured through the cable as specified for PoE in the standard published by the IEEE 802.3 committee.

Embodiment 29

The method of embodiment 25, further comprising coupling one or more switches of resistors to the cable based to provide the information.

Embodiment 30

The method of any of embodiments 25-29, further comprising: receiving the information through a radio-frequency communication at a first time; storing the information in a radio-frequency identification (RFID) chip; reading the information from the RFID chip through a wired interface at a second time later than the first time; and sending the information as data on the cable to provide the information over the cable.

Embodiment 31

The method of any of embodiments 25-30, the lighting load comprising an LED driver.

Embodiment 32

At least one non-transitory machine readable medium comprising one or more instructions that in response to being executed on a computing device cause the computing device to carry out a method according to any one of embodiments 1 to embodiment 31.

Embodiment 33

An apparatus for controlling brightness of a luminaire, the apparatus comprising: a first connector to couple to a drive cable for the luminaire; an interface to a computer network; power circuitry, coupled to the first connector, to generate a power signal at the first connector; a processor, coupled to the interface to the computer network and the power circuitry; a memory, coupled to the processor and storing instructions which, as executed by the processor, cause the processor to perform a method comprising: receiving a drive characteristic for the luminaire over a cable coupled to the luminaire; receiving a brightness level for the luminaire over a computer network; generating a power signal based on both the brightness level and the drive characteristic; and providing the power signal to the luminaire over the cable.

Embodiment 34

The apparatus of embodiment 33, the method further comprising: calculating a percentage of on time of the power signal based on the brightness and the drive characteristic indicating that a lighting element of the luminaire utilizes a constant voltage drive signal; and using the percentage of on time to generate the power signal using pulse-width modulation or pulse-density modulation.

Embodiment 35

The apparatus of embodiment 33, the method further comprising: calculating a current level for the power signal is on based on the brightness and the drive characteristic indicating that a lighting element of the luminaire utilizes a constant current drive signal; and generating the power signal with the calculated current level.

Embodiment 36

The apparatus of embodiment 33, the method further comprising: calculating a current level for the power signal is on based on the brightness and the drive characteristic indicating a brightness vs current relationship for the lighting element; and generating the power signal with the calculated current level.

Embodiment 37

The apparatus of any of embodiments 33-36, the method further comprising: receiving information related to standards compliance from the luminaire over the cable; and determining whether to provide the power signal to the luminaire over the cable in response to the received information.

Embodiment 38

The apparatus of any of embodiments 33-37, wherein the cable is compliant with power over Ethernet (PoE) cable requirements in a standard published by an IEEE 802.3 committee.

Embodiment 39

The apparatus of embodiment 38, said receiving the drive characteristic comprising: receiving data on wires of the cable that are not specified for use by 10/100BASE-T communication on the cable using a protocol other than an Ethernet protocol.

Embodiment 40

The apparatus of any of embodiments 33-39, said receiving the drive characteristic comprising: measuring two or more resistances between wires of the cable; and determining the drive characteristic based on the two or more resistances.

Embodiment 41

The apparatus of any of embodiments 33-40, the luminaire comprising an LED driver.

Embodiment 42

An apparatus for providing power to a device over a cable, the apparatus comprising: a first connector to couple to the cable for the device; an interface to a computer network; power circuitry, coupled to the first connector, to generate a power signal at the first connector; and a processor, coupled to the interface to the computer network and the power circuitry, the processor programmed to determine whether the device is able to receive power over the cable as specified by the open industry standard; in response to determining that the device is able to receive power over the cable as specified by the open industry standard, the processor is further programmed to provide power to the device over the cable as specified by the open industry standard; in response to determining that the device is not able to receive power over the cable as specified by the open industry standard, the processor is further programmed to: receive information from the device over the cable; expose an existence of the device over a computer network; receive a command for the device over the computer network; and provide a power signal over the cable to the device based on the command and the received information.

Embodiment 43

The apparatus of embodiment 42, wherein the open industry standard is a standard published by an IEEE 802.3 committee.

Embodiment 44

The apparatus of embodiment 43, wherein the cable is compliant with power over Ethernet (PoE) cable requirements in a standard published by the IEEE 802.3 committee.

Embodiment 45

The apparatus of embodiment 44, the processor further programmed to receive data on wires of the cable that are not specified for use by 10/100BASE-T communication on the cable as at least a part of said receiving the information from the device over the cable comprising.

Embodiment 46

The apparatus of embodiment 44 or 45, the processor, as at least a part of said determining whether the device is able to receive power over the cable as specified by the open industry standard, further programmed to: attempt to communicate with the device using a protocol other than an Ethernet protocol over wires of the cable that are not specified for use by 10/100BASE-T communication on the cable; and in response to successful communication with the device using the protocol other than the Ethernet protocol over the wires of the cable that are not specified for use by 10/100BASE-T communication on the cable, determine that the device is not able to receive the power over the cable as specified by the open industry standard.

Embodiment 47

The apparatus of embodiment 46, wherein the information is received during the successful communication with the device using the protocol other than the Ethernet protocol over the wires of the cable that are not specified for use by 10/100BASE-T communication on the cable.

Embodiment 48

The apparatus of any of embodiments 44-46, the processor, as at least a part of said determining whether the device is able to receive power over the cable as specified by the open industry standard, further programmed to: attempt to communicate with the device using a protocol other than an Ethernet protocol over wires of the cable that are not specified for use by 10/100BASE-T communication on the cable; in response to an inability to communicate with the device using the protocol other than the Ethernet protocol over the wires of the cable that are not specified for use by 10/100BASE-T communication on the cable: detect a signature resistance of the device through the cable; and determine that the signature resistance is in a first range to indicate that the device is able to receive the power over the cable as specified by the open industry standard.

Embodiment 49

The apparatus of embodiment 42, the processor, as at least a part of said determining whether the device is able to receive power over the cable as specified by the open industry standard, further programmed to: detect a signature resistance of the device through the cable; and determine that the signature resistance is in a first range to indicate that the device is able to receive the power over the cable as specified by the open industry standard.

Embodiment 50

The apparatus of embodiment 42 or 49, the processor, as at least a part of said determining whether the device is able to receive power over the cable as specified by the open industry standard, further programmed to: detect a signature resistance of the device through the cable; and determine that the signature resistance is in a second range to indicate that the device is not able to receive the power over the cable as specified by the open industry standard and is able to provide additional the information about the device's ability to receive the power signal over the cable.

Embodiment 51

The apparatus of embodiment 42, 49, or 50, the processor, as at least a part of said receiving the information from the device over the cable, further programmed to: measure two or more resistances between wires of the cable; and determine the information based on the two or more resistances.

Embodiment 52

The apparatus of any of embodiments 42-51, the processor further programmed to: obtain a brightness level for a lighting element of the device from the command; determine a drive characteristic for the lighting element based on the information; and generate the power signal based on both the brightness level and the drive characteristic.

Embodiment 53

The apparatus of embodiment 52, the device comprising an LED driver,

Embodiment 54

The apparatus of embodiment 52 or 53, the processor further programmed to: calculate a percentage of on time of the power signal based on the brightness and the drive characteristic indicating that the lighting element utilizes a constant voltage drive signal; and use the percentage of on time to generate the power signal using pulse-width modulation or pulse-density modulation.

Embodiment 55

The apparatus of any of embodiments 52-54, the processor further programmed to: calculate a current level for the power signal is on based on the brightness and the drive characteristic indicating that the lighting element utilizes a constant current drive signal; and generate the power signal with the calculated current level.

Embodiment 56

The apparatus of any of embodiments 52-55, the processor further programmed to: calculate a current level for the power signal is on based on the brightness and the drive characteristic indicating a brightness vs current relationship for the lighting element; and generate the power signal with the calculated current level.

Embodiment 57

A light-emitting diode (LED) driver comprising: a first connector to couple to one or more LEDs; a second connector to couple to a cable; first circuitry to provide information about the one or more LEDs at the second connector; and second circuitry to send a power signal received at the second connector to the first connector.

Embodiment 58

The LED driver of embodiment 57, said second circuitry comprising two or more conductors respectively directly connecting two or more contacts on the first connector to two or more contacts on the second connector.

Embodiment 59

The LED driver of embodiment 57, said second circuitry comprising one or more of a full-wave rectifier or a switch configured to control whether the power signal is provide to the first connector.

Embodiment 60

The LED driver of any of embodiments 57-59, said first circuitry configured to provide a signature resistance in a predetermined range outside of a range of 19 kΩ-26.5 kΩ as measured through the second connector as specified by an IEEE power over Ethernet specification, wherein the second connector comprises an RJ-45 connector.

Embodiment 61

The LED driver of any of embodiments 57-60, said first circuitry comprising one or more switches or resistors configured based on the information to be provided.

Embodiment 62

The LED driver of any of embodiments 57-61, said first circuitry comprising a writeable radio-frequency identification (RFID) chip configured to provide data stored therein through the second connector.

Embodiment 63

The LED driver of any of embodiments 57-62, said first circuitry comprising a non-volatile memory configured to provide data stored therein through the second connector.

Unless otherwise indicated, all numbers expressing quantities, properties, measurements, and so forth, used in the specification and claims are to be understood as being modified in all instances by the term "about." The recitation of numerical ranges by endpoints includes all numbers subsumed within that range, including the endpoints (e.g. 1 to 5 includes 1, 2.78, $\pi$, $3.\overline{33}$, 4, and 5).

As used in this specification and the appended claims, the singular forms "a", "an", and "the" include plural referents unless the content clearly dictates otherwise. Furthermore, as used in this specification and the appended claims, the term "or" is generally employed in its sense including "and/or" unless the content clearly dictates otherwise. As used herein, the term "coupled" includes direct and indirect connections. Moreover, where first and second devices are coupled, intervening devices including active devices may be located there between.

The description of the various embodiments provided above is illustrative in nature and is not intended to limit this disclosure, its application, or uses. Thus, different variations beyond those described herein are intended to be within the scope of embodiments. Such variations are not to be regarded as a departure from the intended scope of this disclosure. As such, the breadth and scope of the present disclosure should not be limited by the above-described exemplary embodiments, but should be defined only in accordance with the following claims and equivalents thereof.

What is claimed is:

1. A method of providing power to a device over a cable, the method comprising:

determining whether the device is able to receive power over the cable as specified by an open industry standard;

in response to determining that the device is able to receive power over the cable as specified by the open industry standard, providing power to the device over the cable as specified by the open industry standard;

in response to determining that the device is not able to receive power over the cable as specified by the open industry standard:

receiving information from the device over the cable;

exposing an existence of the device over a computer network;

receiving a command for the device over the computer network; and providing a power signal over the cable to the device based on the command and the received information.

2. An apparatus for controlling brightness of a luminaire, the apparatus comprising:

a first connector to couple to a cable for the luminaire;

an interface to a computer network;

power circuitry, coupled to the first connector, to generate a power signal at the first connector;

a processor, coupled to the interface to the computer network and the power circuitry;

a memory, coupled to the processor and storing instructions which, as executed by the processor, cause the processor to perform a method comprising:

receiving a drive characteristic for the luminaire over the cable coupled to the luminaire;

receiving a brightness level for the luminaire over a computer network;

generating a power signal based on both the brightness level and the drive characteristic; and providing the power signal to the luminaire over the cable.

3. The apparatus of claim 2, the method further comprising:

calculating a percentage of on time of the power signal based on the brightness and the drive characteristic indicating that a lighting element of the luminaire utilizes a constant voltage drive signal; and using the percentage of on time to generate the power signal using pulse-width modulation or pulse-density modulation.

4. The apparatus of claim 2, the method further comprising:

calculating a current level for the power signal based on the brightness and the drive characteristic indicating that a lighting element of the luminaire utilizes a constant current drive signal; and generating the power signal with the calculated current level.

5. The apparatus of claim 2, the method further comprising:

calculating a current level for the power signal based on the brightness and the drive characteristic indicating a brightness vs current relationship for a lighting element of the luminaire; and generating the power signal with the calculated current level.

6. The apparatus of claim 2, the method further comprising:

receiving information related to standards compliance from the luminaire over the cable; and determining whether to provide the power signal to the luminaire over the cable in response to the received information.

7. The apparatus of claim 2, said receiving the drive characteristic comprising:

measuring two or more resistances between wires of the cable; and determining the drive characteristic based on the two or more resistances.

8. An apparatus for providing power to a device over a cable, the apparatus comprising:

a first connector to couple to the cable for the device;

an interface to a computer network;

power circuitry, coupled to the first connector, to generate a power signal at the first connector; and a processor, coupled to the interface to the computer network and the power circuitry, the processor programmed to determine whether the device is able to receive power over the cable as specified by an open industry standard;

in response to determining that the device is able to receive power over the cable as specified by the open industry standard, the processor is further programmed to provide power to the device over the cable as specified by the open industry standard;

in response to determining that the device is not able to receive power over the cable as specified by the open industry standard, the processor is further programmed to:

receive information from the device over the cable;

expose an existence of the device over the computer network;

receive a command for the device over the computer network; and provide the power signal over the cable to the device based on the command and the received information.

9. The apparatus of claim 8, wherein the open industry standard is a standard published by an IEEE 802.3 committee.

10. The apparatus of claim 9, wherein the cable is compliant with power over Ethernet (PoE) cable requirements in a standard published by the IEEE 802.3 committee.

11. The apparatus of claim 10, the processor further programmed to receive data on wires of the cable that are not specified for use by 10/100BASE-T communication on the cable as at least a part of said receiving the information from the device over the cable.

12. The apparatus of claim 10, the processor, as at least a part of said determining whether the device is able to receive power over the cable as specified by the open industry standard, further programmed to:

attempt to communicate with the device using a protocol other than an Ethernet protocol over wires of the cable that are not specified for use by 10/100BASE-T communication on the cable; and in response to successful communication with the device using the protocol other than the Ethernet protocol over the wires of the cable that are not specified for use by 10/100BASE-T communication on the cable, determine that the device is not able to receive the power over the cable as specified by the open industry standard.

13. The apparatus of claim 12, wherein the information is received during the successful communication with the device using the protocol other than the Ethernet protocol over the wires of the cable that are not specified for use by 10/100BASE-T communication on the cable.

14. The apparatus of claim 10, the processor, as at least a part of said determining whether the device is able to receive power over the cable as specified by the open industry standard, further programmed to:

attempt to communicate with the device using a protocol other than an Ethernet protocol over wires of the cable that are not specified for use by 10/100BASE-T communication on the cable;

in response to an inability to communicate with the device using the protocol other than the Ethernet protocol over the wires of the cable that are not specified for use by 10/100BASE-T communication on the cable:

detect a signature resistance of the device through the cable; and determine that the signature resistance is in a first range to indicate that the device is able to receive the power over the cable as specified by the open industry standard.

15. The apparatus of claim 8, the processor, as at least a part of said determining whether the device is able to receive power over the cable as specified by the open industry standard, further programmed to:

detect a signature resistance of the device through the cable; and determine that the signature resistance is in a first range to indicate that the device is able to receive the power over the cable as specified by the open industry standard.

16. The apparatus of claim 8, the processor, as at least a part of said determining whether the device is able to receive power over the cable as specified by the open industry standard, further programmed to:

detect a signature resistance of the device through the cable; and determine that the signature resistance is in a second range to indicate that the device is not able to receive the power over the cable as specified by the open industry standard and is able to provide additional the information about the device's ability to receive the power signal over the cable.

17. The apparatus of claim 8, the processor, as at least a part of said receiving the information from the device over the cable, further programmed to:

measure two or more resistances between wires of the cable; and determine the information based on the two or more resistances.

18. The apparatus of claim 8, the processor further programmed to:

obtain a brightness level for a lighting element of the device from the command;

determine a drive characteristic for the lighting element based on the information; and generate the power signal based on both the brightness level and the drive characteristic.

19. The apparatus of claim 18, the device comprising an LED driver.

20. The apparatus of claim 18, the processor further programmed to:

calculate a percentage of on time of the power signal based on the brightness and the drive characteristic indicating that the lighting element utilizes a constant voltage drive signal; and use the percentage of on time to generate the power signal using pulse-width modulation or pulse-density modulation.

21. The apparatus of claim 18, the processor further programmed to:

calculate a current level for the power signal based on the brightness and the drive characteristic indicating that the lighting element utilizes a constant current drive signal; and generate the power signal with the calculated current level.

22. The apparatus of claim 18, the processor further programmed to:

calculate a current level for the power signal based on the brightness and the drive characteristic indicating a brightness vs current relationship for the lighting element; and generate the power signal with the calculated current level.

* * * * *